US005454565A

United States Patent [19]

Ramirez

[11] Patent Number: 5,454,565

[45] Date of Patent: Oct. 3, 1995

[54] IMPACT WEAPON STRUCTURE

[76] Inventor: Leonard Ramirez, P.O. Box 8876, Pittsburg, Calif. 94565

[21] Appl. No.: 295,605

[22] Filed: Aug. 25, 1994

[51] Int. Cl.[6] ..... F41B 15/02

[52] U.S. Cl. ..... 273/84 R; 482/108

[58] Field of Search ..... 273/84 R, 81 B, 273/81.4; 482/49, 50, 106, 108, 109; 601/121, 135

[56] References Cited

U.S. PATENT DOCUMENTS

| | | | |
|---|---|---|---|
| D. 205,456 | 8/1966 | Combs | D30/1 |
| 1,909,932 | 5/1933 | Digel . | |
| 2,026,077 | 12/1935 | True | 273/84 |
| 2,099,447 | 11/1937 | Matsuyama | 273/84 |
| 3,104,648 | 9/1963 | Fisher | 482/108 |
| 3,106,398 | 10/1963 | Gowdey | 273/84 |
| 4,647,037 | 3/1987 | Donohue | 482/108 |
| 5,108,097 | 4/1992 | Ashihara | 273/84 |
| 5,242,349 | 9/1993 | Reiff et al. | 482/50 |

FOREIGN PATENT DOCUMENTS

| | | | |
|---|---|---|---|
| PCT/89/03107 | 7/1989 | WIPO | 273/84 |

*Primary Examiner*—V. Millin
*Assistant Examiner*—William M. Pierce
*Attorney, Agent, or Firm*—Bielen, Peterson & Lampe

[57] ABSTRACT

An impact weapon having an elongated body with an undulated, continuous, outer surface which extends along an axis. First and second end portions are connected to opposite ends of the elongated body. A first depression zone is formed on the continuous undulated outer surface adjacent the first end portion while a second depression zone is formed on the undulated continuous outer surface near the second end portion. The first and second depression zones include at least first and second depressions respectively that are angularly separated from one another about the axis by approximately ninety degrees.

7 Claims, 1 Drawing Sheet

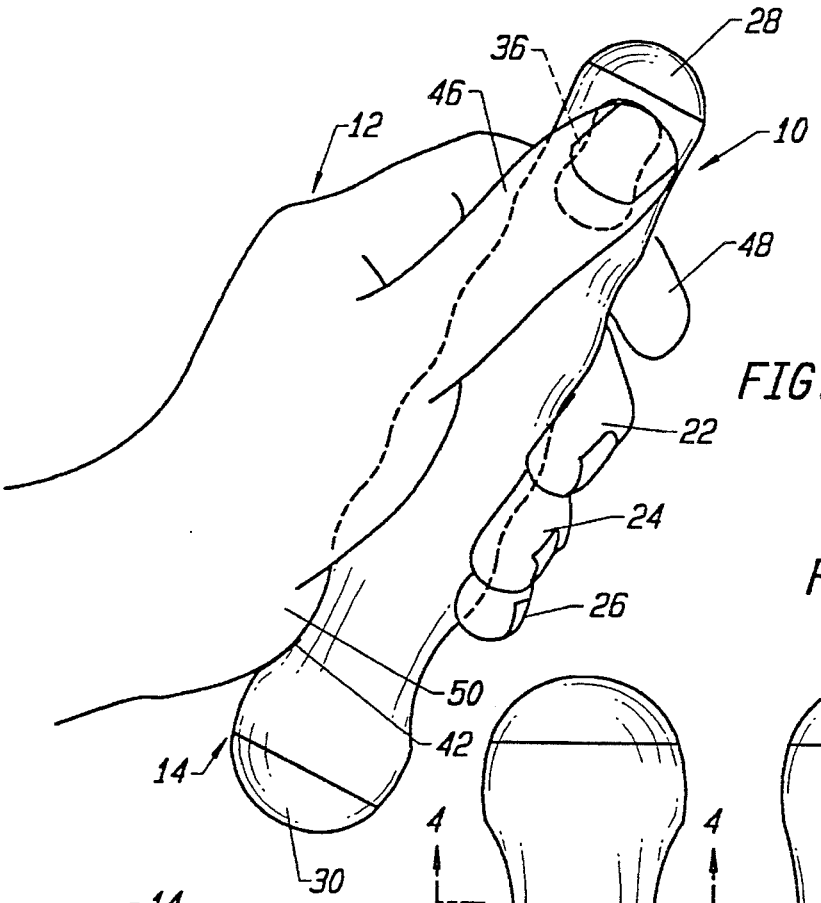
FIG. 1
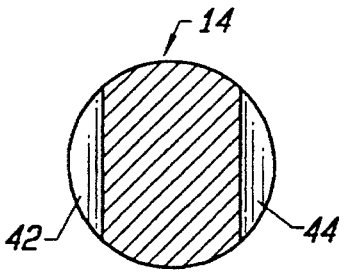
FIG. 4
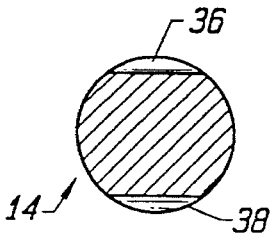
FIG. 5
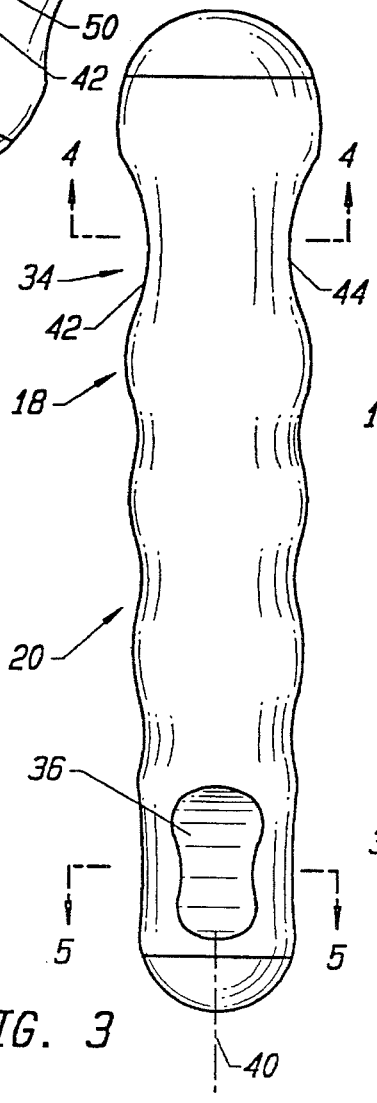
FIG. 3
FIG. 2
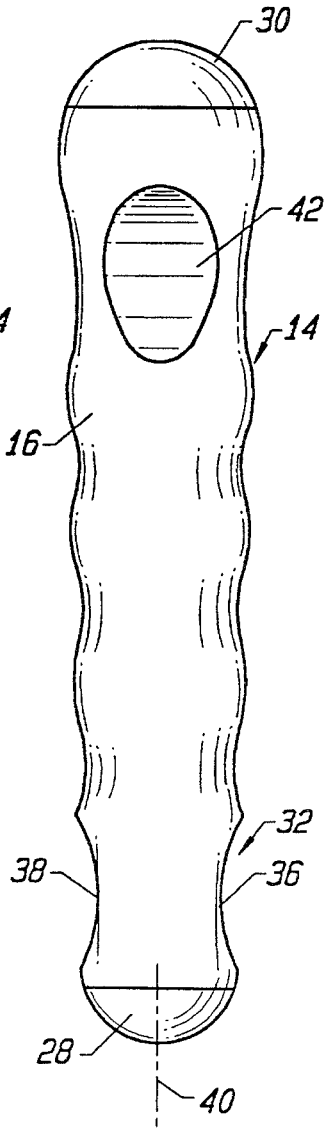

IMPACT WEAPON STRUCTURE

BACKGROUND OF THE INVENTION

The present invention relates to a novel and useful impact weapon.

Many weapons are employed in the martial art and law enforcement areas that do not hurl projectiles. For example, police forces employ nightsticks, clubs, batons and the like. U.S. Pat. Nos. 1,909,932 and 2,026,077 exemplify such weapons. In addition, many police forces employ nunchuck sticks which are found in martial arts.

U.S. Pat. Nos. 2,099,447, 3,106,398, 5,108,097, Des. Pat. No. 205,456, and PCT Application disclosure PCT/US89/03107 describe short handheld weapons which are used to strike an opponent during riot control and arresting procedures. Such prior art weapons include wavy gripping surfaces and blunted ends. Unfortunately, prior art structures are difficult to grip during combat. Moreover, the ends of such weapons are often composed of the same material as the gripping portion which results in the imposition of blows that cause excessive injury to an opponent.

A handheld weapon which is easy to grasp and use in hand-to-hand combat would be a notable advance in the field of police enforcement.

SUMMARY OF THE INVENTION

In accordance with the present invention, a novel and useful impact weapon is herein provided.

The impact weapon of the present invention is intended to be handheld and usable by governmental agencies, such as police forces. Moreover, the weapon of the present invention may also be employed with defensive tactics such as nerve stimulus techniques, control holds, take downs, and escort methods. The impact weapon includes an elongated body formed of rigid or semi-rigid material that possesses an undulated continuous outer surface along an axis. The undulated surface may be formed with regularly spaced undulations along the elongated body that tapers from a large end to a small end. The elongated body terminates in first and second end portions at opposite ends, thereof. The first and second end portions may be constructed of material possessing higher malleability or resilience than the material forming the undulated continuous outer surface of the elongated body. Where the elongated body is tapered, the first end portion is smaller than the second end portion. Both first and second end portions may be blunted and/or rounded to prevent penetration of the same into an opponent.

First and second depression zones are also formed on the undulated continuous outer surface adjacent the first and second end portion respectively. Each depression zone may include at least one depression, and preferably two which are separated from each other by one hundred and eighty degrees around the outer undulated continuous outer surface of the elongated body. Any one depression of the first depression zone is separated from any one depression in the second depression zone by ninety degrees about the elongated body axis. Thus, the first and second depression zones provide natural gripping and rest zones for the opposed thumb and index finger of the hand and palm and small finger of the hand, respectively.

It may be apparent that a novel and useful impact weapon has been herein described.

It is therefore an object of the present invention to provide an impact weapon which is easy to use during hand-to-hand combat and is superior in providing gripping surfaces for the human hand during use.

Another object of the present invention is to provide an impact weapon useable in police work which includes striking surfaces that are more resilient or malleable than the gripping surface of the weapon.

Another object of the present invention is to provide an impact weapon which is easily carried by a police officer and used to control offenders in a persuasive, but nonlethal manner.

The invention possesses other objects and advantages especially as concerns particular characteristics and features thereof which will become apparent as the specification continues.

BRIEF DESCRIPTION OF THE DRAWINGS

FIG. 1 is a perspective view of the device of the present invention and use by a human.

FIG. 2 is a top plan view of the weapon of the present invention.

FIG. 3 is a side elevational view of the weapon of the present invention.

FIG. 4 is a sectional view taken along the lines 4—4 of FIG. 3.

FIG. 5 is a sectional view taken along the lines 5—5 of FIG. 3.

For a better understanding the invention, references made to the following Detailed Description of the Preferred Embodiments thereof which should be referenced to the prior described drawings.

DETAILED DESCRIPTION OF THE PREFERRED EMBODIMENTS

Various aspects of the present invention will evolve from the following Detailed Description of the Preferred Embodiments thereof which should be taken in conjunction with the prior described drawings.

The invention as a whole is shown in the drawings by reference character 10. The impact weapon 10 is intended to be easily gripped and held by a human hand 12, FIG. 1, during use in combat. With reference to FIGS. 2 and 3, it may be observed that weapon 10 includes as one of its elements an elongated body 14 having an undulated continuous outer surface 16. That is to say, undulated continuous outer surface 16 extends completely around elongated body 14 and includes a multiplicity of rounded ridges 18 and a plurality of valleys 20 therebetween. The plurality of multiplicity of rounded ridges 18 smoothly meets plurality of valleys 20 as depicted in FIGS. 2 and 3. Outer surface 16 serves as a convenient gripping area for the middle and ring fingers 22 and 24 of hand 12, FIG. 1. In addition, little finger 26 of hand 12 may also rest on outer surface 16, which will be described in detail hereinafter. Elongated body 14 includes first end portion 26 and second end portion 30. Elongated body 14 tapers between large second end portion 30 and small first end portion 28 to a certain degree. First and second end portions 28 and 30 may be formed of material which is higher in malleability and/or resilience than elongated body 14 therebetween.

Weapon structure 12 also possesses first depression zone 32 and second depression zone 34 adjacent first end portion 28 and second end portion 30, respectively. First depression zone 32 includes depressions or cut-outs 36 and 38 which are separated from each other by approximately one hundred eighty degrees about axis 40 of elongated body 14. Likewise, second depression zone 34 includes depressions or cut-outs 42 and 44 which are also separated from each other by one hundred eighty degrees about axis 40. Notably, depressions 36 and 38 are separated from either depression 40 or 44 by ninety degrees, FIGS. 4 and 5, to permit the sure gripping of weapon structure 10.

In operation, the user grips weapon structure 10 as depicted in FIG. 1. That is to say thumb 46 of hand 12 extends into depression 36 of depression zone 32. Index finger 48 rests on outer surface 16 of elongated body 14. Lower portion of palm 50 of hand 12 rests in depression 42. The angular separation of depressions 36 and 42 create a natural grip for hand 12. The user is then free to move weapon 10 back and forth in a jabbing matter to strike an opponent with either end portion 28 or 30 as desired.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An impact weapon: comprising:

a. an elongated body, said elongated body including an undulated continuous outer surface along an axis;

b. a first and a second end portion connected to opposite ends of said elongated body, said first end portion, being formed of a material possessing higher malleability than said undulated continuous outer surface of said elongated body;

c. a first depression zone formed on said undulated continuous outer surface adjacent said first end portion of said elongated body;

d. a second depression zone formed on said undulated continuous outer surface adjacent said second end portion; said first and second depression zones including at least first and second depressions, respectively, angularly separated from one another about said axis.

2. The impact weapon of claim 1 in which said first and second depressions of said first and second depression zones are substantially separated from one another about said axis.

3. The impact weapon of claim 1 in which said second end portion is formed of a material possessing a higher, malleability than said undulated continuous outer surface of said elongated body.

4. An impact weapon: comprising:

a. an elongated body, said elongated body including an undulated continuous outer surface along an axis;

b. a first and a second end portion connected to opposite ends of said elongated body, said first end portion being formed of a material possessing greater resilience than said undulated continuous outer surface of said elongated body;

c. a first depression zone formed on said undulated continuous outer surface adjacent said first end portion of said elongated body; and d. a second depression zone formed on said undulated continuous outer surface adjacent said second end portion; said first and second depression zones including at least first and second depressions, respectively, angularly separated from one another about said axis.

5. The impact weapon of claim 1 in which said second end portion is formed of a material possessing greater resilience than said undulated continuous outer surface of said elongated body.

6. An impact weapon: comprising:

a. an elongated body, said elongated body including an undulated continuous outer surface along an axis;

b. a first and a second end portion connected to opposite ends of said elongated body, said second portion being larger than said first end portion and said elongated body tapers between said first and second end portions;

c. a first depression zone formed on said undulated continuous outer surface adjacent said first end portion of said elongated body; and d. a second depression zone formed on said undulated continuous outer surface adjacent said second end portion; said first and second depression zones including at least first and second depressions, respectively, angularly separated from one another about said axis.

7. An impact weapon: comprising:

a. an elongated body, said elongated body including an undulated continuous outer surface along an axis;

b. a first and second end portion connected to opposite ends of said elongated body, said second end portion being larger than said first end portion;

c. a first depression zone formed on said undulated continuous outer surface adjacent said first end portion of said elongated body, said first depression zone including a pair of depressions separated from each other about said axis of said elongated body by substantially one-hundred eight degrees; and d. a second depression zone formed on said undulated continuous outer surface adjacent said second end portion, said second depression zone including a pair of depressions separated from each other about said axis of said elongated body by substantially one-hundred eighty degrees.

* * * * *